United States Patent [19]

Shotbolt

[11] 4,081,503

[45] Mar. 28, 1978

[54] METHOD OF FORMING CLOSURE LINERS

[75] Inventor: Keith Shotbolt, Gerrards Cross, England

[73] Assignee: W. R. Grace & Co., Cambridge, Mass.

[21] Appl. No.: 491,749

[22] Filed: Jul. 25, 1974

[51] Int. Cl.[2] ..... B29D 31/00

[52] U.S. Cl. ..... 264/268; 264/294; 264/296

[58] Field of Search ..... 264/268, 294, 296, 25

[56] References Cited

U.S. PATENT DOCUMENTS

| | | | |
|---|---|---|---|
| 2,546,085 | 3/1951 | Briscoe | 264/25 |
| 2,688,776 | 9/1954 | Evans | 264/268 |
| 3,135,019 | 6/1964 | Aichele | 264/268 X |
| 3,509,252 | 4/1970 | Baehr | 264/296 |

*Primary Examiner*—Richard R. Kucia
*Attorney, Agent, or Firm*—C. E. Parker; Lowell H. McCarter

[57] ABSTRACT

Container closures are given the customary sealing gasket of plastics material by a two stage deformation of a pellet of the plastics material. In a first stage the material is partly deformed and is heated by direct conduction from a heated deforming member, and in the second stage a relatively cool final moulding die effects further deformation to impart the desired finished configuration to the gasket. The pressure member, and possibly also a workpiece support on which the upturned closure rests, is heated by means of a radiant heat source directing radiant heat onto a blackened roughened surface of the pressure member, and the workpiece support where applicable. The pressure member has a low-adhesion surface of polytetrafluoroethylene.

3 Claims, 7 Drawing Figures

METHOD OF FORMING CLOSURE LINERS

BACKGROUND OF THE INVENTION

The present invention relates to a method for moulding thermoplastic compositions. In a preferred form, the invention relates to the moulding of liners or gaskets in container closures.

Hitherto it has been known for example when forming a liner for a container closure to pre-heat the thermoplastic material and to mould the heated and thus softened material using a mould die which is not itself heated and may even be positively cooled so that in either case it presents a relatively cool moulding surface. However, the above described moulding process involves a considerable dwell time of the thermoplastic material in an oven, through which closures carrying metered quantities of the plastics material, are passed along a tortuous conveyor path. Such a system is, for example, disclosed in our British patent application No. 5948/73 in which the heat is imparted to the thermoplastic material by radiation within the oven. This has the disadvantage that, if for any reason the movement of the closure-carrying conveyor through the oven stops, the closures in the oven rapidly become overheated and "scorched" with the result that they are unsuitable for use.

SUMMARY OF THE INVENTION

The present invention proposes to mould thermoplastic material by firstly applying heat directly to the material, which preferably is in the form of a pellet or spot, using a pressure member which exerts pressure on the material to impart thereto an initial deformation, and subsequently moulding the material to final desired dimensions using a die the temperature of which is lower than that of the heated thermoplastic material. The die is thus desirably not heated at all or is positively cooled.

In order to ensure that the thermoplastic material does not stick to the heating member that surface of the pressure member which in use contacts the thermoplastic material may be coated with a medium imparting low-adhesion characteristics. Preferably the coating may comprise polytetrafluoroethylene (P.T.F.E.). More preferably, the particular P.T.F.E. coating employed may be in accordance with the "ARMOUR-COTE" system in which the surface of the pressure member is first of all given a sintered stainless steel layer, onto which the subsequently applied P.T.F.E. can more securely be keyed.

By exerting pressure on the pellet or spot while heating it, the thickness of the thermoplastic material is reduced and the area is increased. Thus the rate of transfer of heat is increased markedly. For example, if the diameter of a pellet is doubled the heat transfer is increased by 16 times.

The invention also proposes apparatus for applying a moulded surface covering of thermoplastic material to a work-piece, comprising a work-piece support for supporting the work-piece, means for feeding thermoplastic material into contact with the work-piece, a pressure member mounted and drivable for movement in a direction towards a supported work-piece so that the pressure member bears firmly against and softens and thins the thermoplastic material, means for imparting heat to the pressure member and a moulding die member adapted to bear against the softened thermoplastic material and impart the desired final dimensions thereto.

Preferably, the pressure member is given a low-adhesion surface such as P.T.F.E.

Desirably the apparatus may include a rotary turret incorporating a plurality of workpiece supports and a plurality of separate pressure members, all associated with a common radiant heat source and arranged on a circular arcuate path around the axis of rotation of the turret. The workpiece can be supported on a respective one of the workpiece supports and the associated pressure members will be driven down into contact with thermoplastic material on the workpiece to impart heat thereto while causing initial deformation of the thermoplastic material.

Advantageously, means may be provided for heating the workpiece supports, so that the workpieces themselves are heated thereby.

Conveniently the means for heating the pressure member and/or the workpiece support may comprise a source of radiant heat located adjacent the pressure member. Advantageously, the pressure member includes a blackened surface disposed directly opposite the radiant heat source which, in a preferred form, may be an infra-red electrical heating element which can be caused to glow when energised.

Other alternative forms of heating the pressure member and/or the workpiece supports may be employed. For example the heat may be imparted by direct conduction from electrical cartridge heaters, or by playing a gas flame on the heating member and/or the support. A stripper member may be located above the workpiece path to hold down the workpiece as the pressure member is withdrawn after hot pressing the plastics material. Where the workpieces are container closures the stripper member is a plate with a slot extending peripherally of the turret to receive the pressure member, in this case a plunger which may have flats formed to enter the slot while the hot pressing operation is carried out by a moulding head below the stripper plate which may or may not have similar flats, as desired.

The heating turret may include separate temperature sensors for detecting the temperatures of the workpiece supports and the temperatures of the pressure members and a separate control system may desirably be provided for controlling the temperatures of the supports and the pressure members to maintain optimum heat transfer conditions.

This heating turret may be fed from an insertion device, such as a further turret of the form disclosed in our copending application No. 5948/73, and the heating turret may be arranged to deliver the workpiece with partly deformed plastics material directly to a further moulding turret.

The workpieces may suitably be preheated before insertion of the plastics material by means of a rotary preheating turret in which the workpieces rest on hot supports. The hot supports may be heated by electrical cartridge heaters, gas flames or the like. Advantageously the supports may be heated by means of conduction from a hot receptor arranged to receive heat from a stationary radiant source such as an infra-red heating element.

By avoiding the conventional convective or direct radiation heating of the plastics material, it is possible to impart to the plastics material the desired softness together with an advantageous pre-shaping in a time which, when moulding liners or gaskets in container closures, can be reduced from the order of 25–40 seconds down to the order of 2.5 seconds. In the event of shut down of the machine while the heating turret is loaded, very few if any closures will be rendered unusable, because they are not subjected to intense heat.

Similarly the use of direct conduction for preheating the empty workpieces means that heat can be transferred quickly into the workpiece from a large capacity heat-transmitting conductor member without the need for fierce radiation directly onto the workpiece surface since this radiation tends to mar some lacquers used on container closures.

The main heating turret used in the preferred embodiment of apparatus according to the invention is far more compact than the previously used ovens.

BRIEF DESCRIPTION OF THE DRAWINGS

In order that the present invention may more readily be understood the following description is given, merely by way of example, reference being made to the accompanying drawings in which.

DESCRIPTION OF PREFERRED EMBODIMENTS

Figure 1:
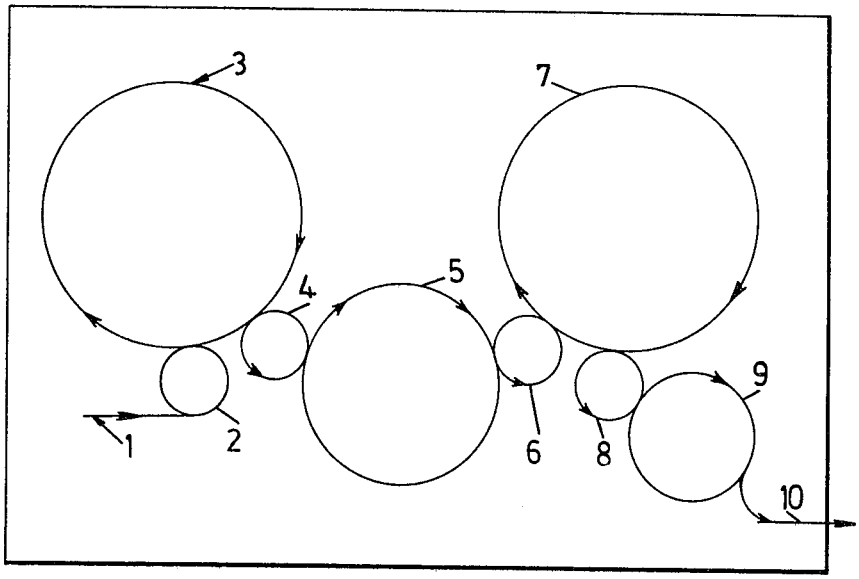
FIG. 1 is a schematic top plan view of apparatus for lining container closures in accordance with the present invention.
Figure 5:
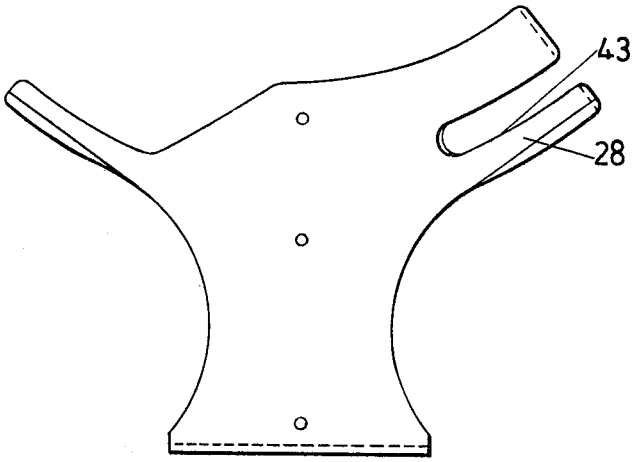
FIG. 5 is a plan view of the stripping plate shown in FIG. 4.

Referring now to FIG. 1, the closures to be lined are advanced along a schematically illustrated chute conveyor generally designated 1, to a feed star wheel 2 from which the stream of empty closures is fed to a preheating turret 3 to be preheated by direct conduction of heat from a closure support. The closures passing around the turret 3 are heated to a temperature sufficient to cause subsequently inserted pellets of thermoplastic material to adhere securely to the inner face of the closure for subsequent operations.

From the preheater turret 3 the closures pass around a first transfer star wheel 4 and are fed to a pellet insertion trurret 5, preferably of the form disclosed in our copending British patent application No. 5948/73.

The star wheel 4 has a plurality of pockets which advance the closures while the disc-like end walls of the closures ride on a smooth guide rail which has a small contact area with the closures so as to minimize heat loss from the already preheated closures and to avoid scratching the decorative lacquer which will already have been applied to the outer surface of the closure.

Individual pellets of thermoplastic material are introduced to respective ones of the preheated closures by turret 5 before the closures are transferred by means of a similar secondary transfer star wheel 6 onto a turret 7, where they are to be heated and initially deformed, as will be described in more detail below.

From the heating turret 7 the closure, which now have soft flattened plastics disc therein, are transferred, via a third similar type of transfer star wheel 8, to a moulding turret 9 where mould dies considerably cooler than the thermoplastic material impart the final desired shape to the thermoplastic material, before the closures then advance to an inspection station along the same or a different conveyor as shown at 10.

Figure 2:
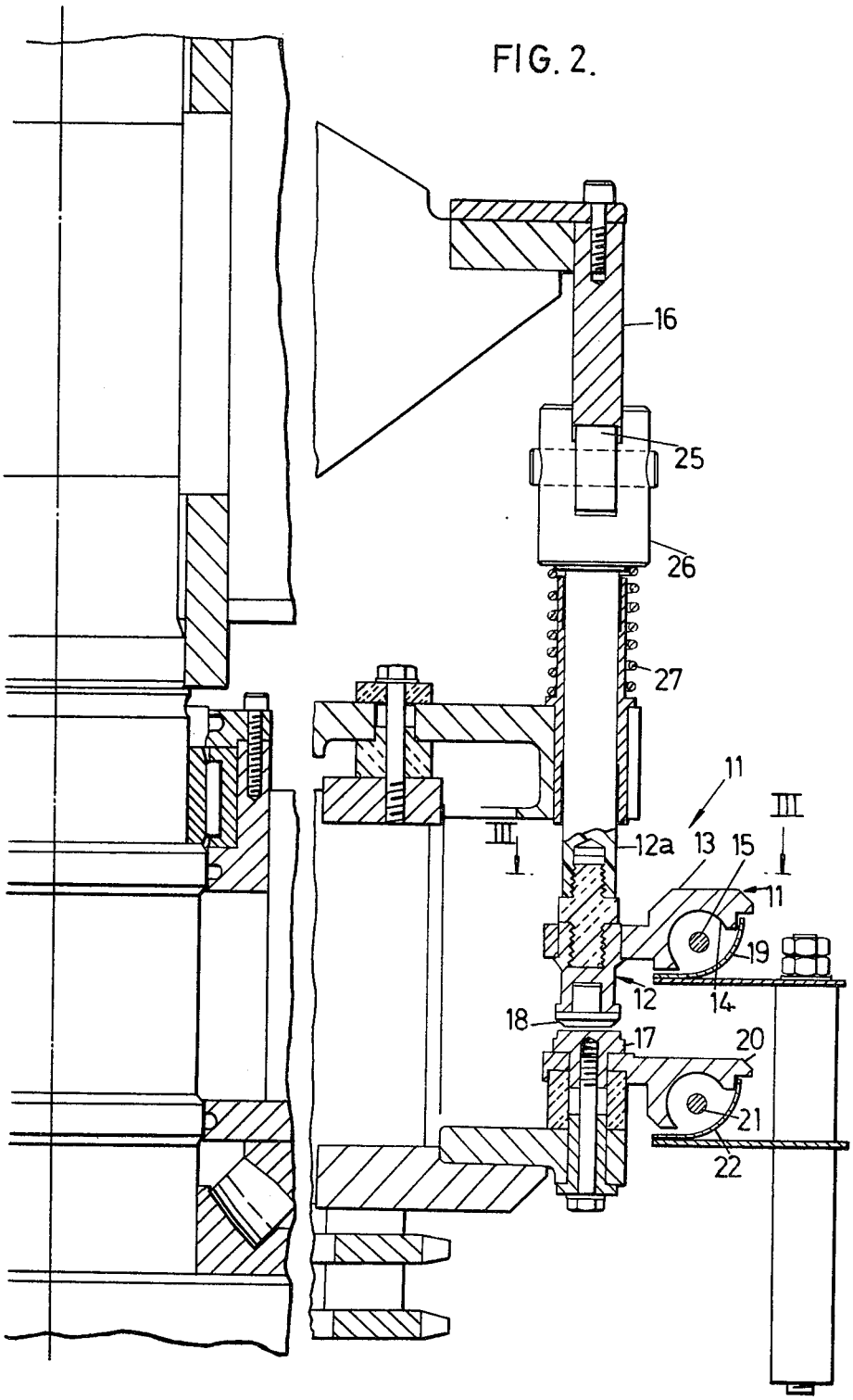
FIG. 2 is a vertical sectional view through one of the positions on the heating/pressing turret.

In FIG. 2, one station 11 on the heater turret 7 is shown as comprising a vertically movable pressure member in the form of a heating plunger 12 having an upper part 12*a* of an asbestos impregnated phenolic resin known by the Trade Name Ferobestos. At the top end of the upper part 12*a* is the cam follower roller 25 mounted in a bifurcated carrier 26 which is spring urged upwardly by a helical compression spring 27 into contact with a circumferential cam 16.

The heating plunger 12 carries with it a heat-absorption member 13 having an arcute surface 14 arranged on a circular arc about the centre of a thermostatically controlled heating element 15 which itself extends around the circumference of the main turret.

The circumferential cam 16 at the top of the machine provides the means for causing periodic raising and lowering of each plunger 12 relative to a container closure resting on a support member 17, so that a removable bottom pad 18 of the plunger enters the closure to compress the pellet of a thermoplastic material, in this case a composition consisting of polyethylene and butyl rubber as disclosed in British Pat. Nos. 1112023, 1112024 and 1112025. Amongst many other suitable materials is polyvinyl chloride. Also suitable are the mixtures of polyethylene and styrene butadiene as disclosed in British Pat. Nos. 1196125 and 1196127.

This action imparts heat to the pellet allowing it to soften and at the same time to spread due to the downward compression of the plunger. By the end of the heating and compression operation the entire body of the plastics material is soft and ready for a subsequent moulding operation using a relatively cold mould at the moulding turret 9.

The arcuate surface 14 of the heat receiving member 13 is both blackened and roughened so as to improve its heat-absorption characteristics with respect to radiant heat, and a reflector 19, extending around the circumference of the turret, throws back radiant heat against the surface 14. The heat picked up by the surface 14 is then conducted through the heat absorption member 13 to the plunger 12 so as to maintain the bottom surface 18 at a temperature of approximately 200° C to impart the necessary heat to the plastics material.

The closure-supporting member 17 is provided with a similar heat-absorbing member 20 mounted close to a second separately thermostatically controlled heating element 21 and a second reflector 22 so that the underside of the closure is also heated to assist in transferring heat to the pellet.

The entire turret is driven for rotation in synchronism with the remainder of the apparatus.

Figure 3:
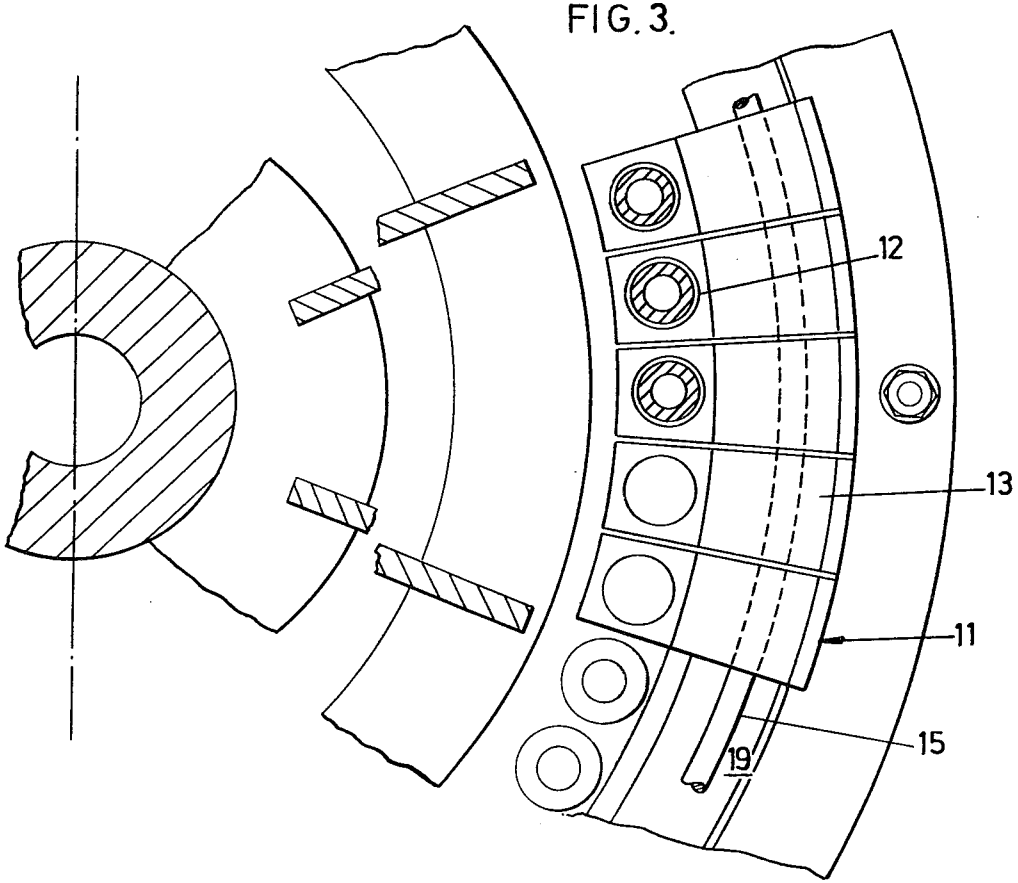
FIG. 3 is a horizontal section on the line III—III of FIG. 2.

As shown in the top plan view of FIG. 3, the various heat absorbing members for the closure support members and the plungers are angularly spaced from one another to avoid any problems of circumferential expansion in the range of temperature encountered between room temperature and the operating temperature of around 200° C.

Compressing the pellet as it is heated ensures that there is improved contact area between the plastics material and the heated surface of the plunger and the surface 18 is coated with the "Armourcote" technique using sintered stainless steel as a keying surface for P.T.F.E. The portion of the plunger 12 carrying the P.T.F.E. may be detachable, so that it can be replaced should the P.T.F.E. become worn.

The heating system of the preheater turret 3 is similar to that of the main heating/pressing turret 7 in that the closure supports are heated from below by radiation from a thermostatically controlled heating element with a reflector to throw back the radiant heat towards a blackened heat-receiving surface of the closure support.

A stripping plate (not shown) is provided just above the workpiece path around the turret 7 at the position where the plungers are withdrawn from the closures, this stripping plate having an arcuate slot through which the plunger extends slidably. As the plungers are withdrawn upwardly the rims of the closure skirts will strike the underside of the stripper plate to hold the closures down to effect separation of the plungers from the heated plastics material.

Figure 4:
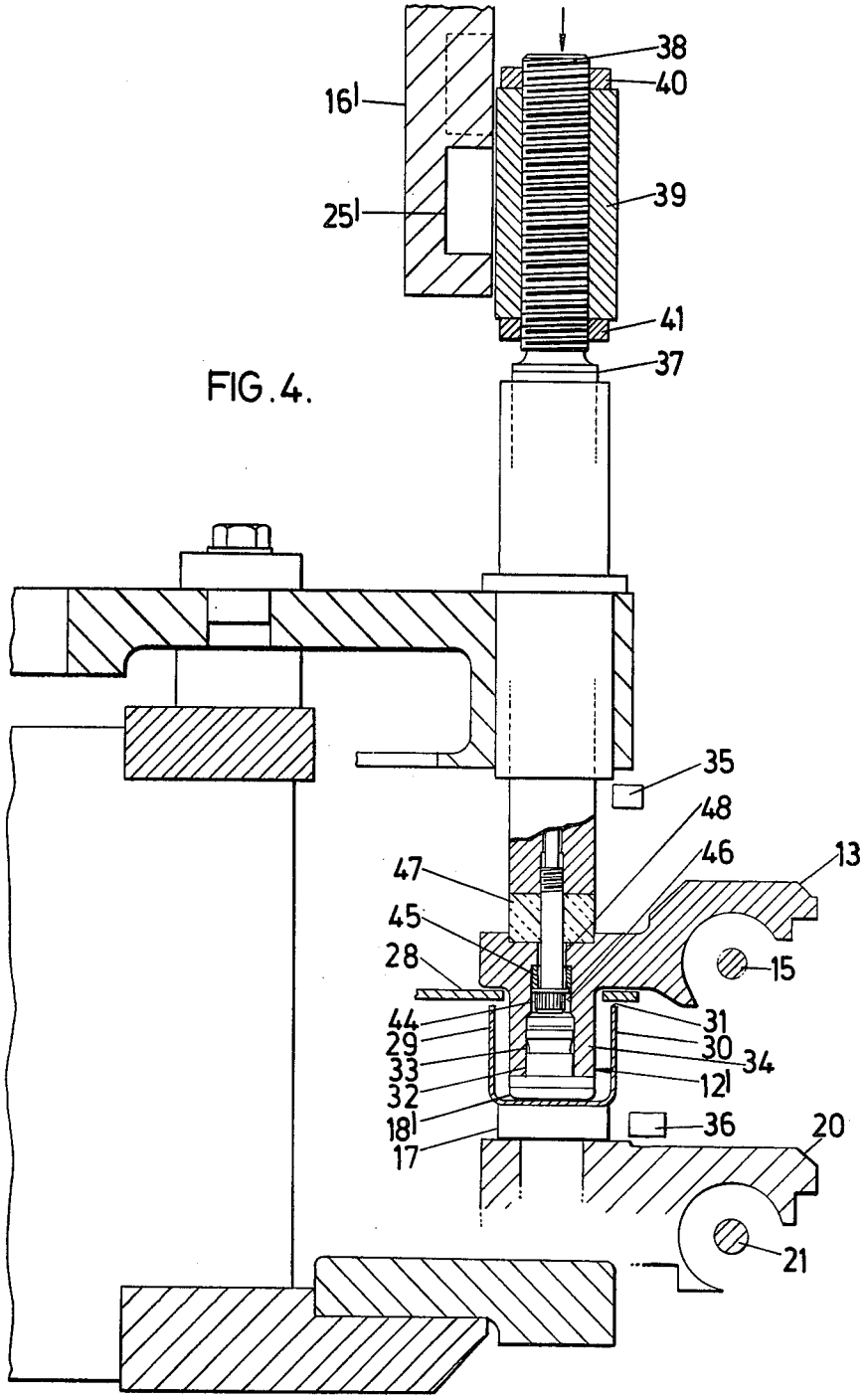
FIG. 4 is a view similar to FIG. 2 but showing an alternative form of heating/pressing turret.
Figure 6A:
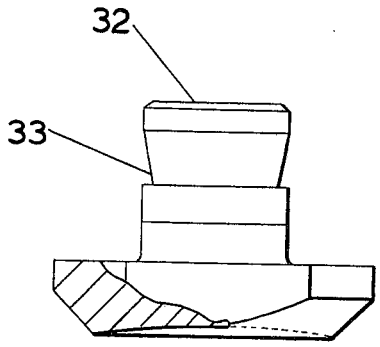
FIG. 6*a* and 6*b* are a side elevational, partly sectional and an end elevational view, respectively, of the plunger bottom pad shown in FIG. 4.
Figure 6B:
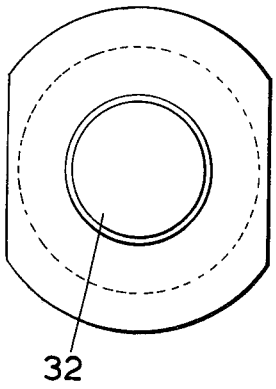

FIG. 4 shows a vertical sectional view similar to that of FIG. 2, but depicts a modified form of the heating plunger construction for use on the main heating/pressing turret 7.

Since many of the components of the turret of FIG. 4 are identical to those of FIG. 2, the same reference numerals have, in many cases been employed. Where the reference numerals in FIG. 4 have been primed, they denote modified elements which may be analogous to the corresponding elements of FIG. 2.

The plunger 12' in this embodiment of the turret co-operates with a slotted stripping plate 28 which extends horizontally above the path of the closure support members 20 at the part of the heating/pressing turret where the plunger 12' is to rise away from the partially moulded plastics composition in the container closure 30.

The stripping plate 28 acts in the same manner as the non-illustrated stripper plate of FIG. 2 to hold down the closure 30 since the rim 31 of the skirt of the closure will rise to strike the underside of the stripping plate 28 as the plunger is withdrawn and further withdrawal of the plunger 12' will raise the bottom pad 18' away from the heated and partially formed plastics composition in the bottom of the closure since the adhesion of the plastics composition to the bottom of the closure is stronger than its adhesion to the bottom pad 18', by virtue of the coating of polytetrafluoroethylene on the underside of the pad 18'.

In order to allow this co-operation between the stripper plate 28 and the plunger 12', the plunger and the bottom pad both have flats 29 formed in their lateral surfaces and these flats leave the plunger 12', 18' with a transverse dimension which is considerably less than the diameter parallel to the flats. These flats allow the plunger to be withdrawn upwardly into the slot of the stripper plate so as to release the closure for radially outward removal from the press/heating turret 7 at the third transfer star wheel 8 for advancing to the moulding turret 9.

After this stripping action has been completed, the plunger 12' will continue its travel around the turret 7 and will pass out of the end of the slot 43 in the stripper plate 28 after the closure 30 has been separated from the heating pad 18'.

This flatted circular form of pad 18' is particularly advantageous where, as illustrated in FIG. 4, the closures 30 are of the deep drawn type without a beaded rim to the skirt, since the transverse dimension of the stripper plate slot will be as small as possible so that the delicate closure rim bears against the stripper plate over as great as possible a part of its periphery thereby distributing the end loading on the skirt rim more evenly.

As illustrated in FIGs. **6*a* and 6*b*, the mounting system for the bottom pad 18' involves a stud 32 of unthreaded form on the pad, but having at some point along its length a peripheral groove 33 whose lower wall is defined by a radially extending planar face and whose upper wall is of upwardly divergent conical form when in situ. A grub screw 34 extends radially inwardly of the plunger 12', as shown in FIG. 4, and a similar screw extends inwardly from a diametrically opposite position so that these two screws both abut the upwardly divergent conical wall of the groove to pull the stem 32 upwardly as the two grub screws 34 are tightened. In this way, a secure clamping action can be exerted on the bottom plate 18' independently of the particular orientation of the pad 18'** about the vertical axis.

Although not shown in detail in FIG. 2, the bottom pad 18 is circular and has a threaded stem which is screwed into a threaded socket in the bottom end of the plunger 12. Such an arrangement requires a widening at the downstream end of the stripper plate slot to accommodate the circular plunger. The initial separating action of the plunger and closure occurs at a narrower upstream portion of the slot where flats in the plunger body allow the plunger body to pass along the slot even though the bottom pad 18 is wider than this part of the slot and is still disposed in the closure below the narrow slot portion. The arrangement in FIG. 4 is preferably where flatted bottom pads 18' are to be used.

The side elevational, partly sectional, view of FIG. **6*a*** illustrates the profile of one form of pad where the end face is slightly concavely dished.

Temperature control for the heating elements 15 and 21 is effected by means of a thermocouple 35 which picks up radiant heat from the heat-collecting member 13 for the plunger 12', and a further thermocouple 36 for sensing the temperature of the closure support bosses 17. The thermocouple 35 is effective to control the power supply to heating element 15 for maintaining accurate temperature stability of the plunger 12' and the thermocouple 36 is effective to control the power supply to the lower heating element 21 for ensuring temperature stability of the closure support 17.

During rotation of the turret all the various closure support members 17 and all the various heating members 13 will pass the temperature monitoring station so that the power supply to the heaters will vary in response to the mean temperature, around the turret, of these respective sets of elements.

A further difference between the turret of FIG. 2 and that of FIG. 4 is that the peripheral cam no longer acts purely by virtue of its downwardly facing edge surface against which the roller 25 is spring urged, but instead in FIG. 4 the cam 16' has a cam slot formed in one edge to receive the cam follower roller 25' which in FIG. 4 is mounted on the side of the plunger body at the top end of the plunger. This dispenses with the need for a spring return action since the slot can now both drive the plunger downwardly and lift the plunger up again thanks to the side mounted cam follower roller configuration.

Furthermore, whereas in FIG. 2 the upper plunger portion **12*a*** was formed of the asbestos-impregnated phenolic resin material known by the trade name Ferobestos, chosen for its temperature stability characteristics, it has been found convenient to adopt a different arrangement in the embodiment of FIG. 4. Here the plunger 12 has a stainless steel main body portion 37 with an integral threaded upper shaft portion 38 at the upper end of this portion 37. The threaded shaft extends as a clearance fit through the carrier 39 on which the cam follower roller 25' is secured in a side-mounted configuration.

The heat-receiving member 13 is clamped to the bottom end of the stainless steel body portion 37 by means of a cap screw 44 which bears against a heat-insulating bush 45 of the thermal insulating material known by the trade name Sindanyo. This bush 45 is received in a bore 46 of the heat-receiving member 13, and a further heat insulating bush 47 is placed between the stainless steel main body portion 37 of the plunger and the upper side of the heat-receiving member 13. Total thermal insulation of the plunger body 37 from the heat-receiving member is completed by an air gap 48 between the screw 44 and the heat-receiving member.

Above and below the carrier 39 are nuts 40 and 41 which can be adjusted in their position up and down the threaded shaft 38 so as to set precisely the vertical distance between the upper face of the cam groove in cam 16' and the lower extremity of the bottom plunger pad 18' at the lobe of the cam. This is clearly an important dimension in the machine since even the smallest inaccuracy in the spacing between the top face of the closure support 17 and the flat underneath face of the pad 18' will provide a considerable variation in the degree of pressing to which the plastics material is subjected during the heating operation. The extent of this squashing action is particularly important in view of the fact that the heat exchange contact area between the bottom pad 18' and the plastics material varies as the square of the radius of the squashed plastics mass. The carrier 39 may be formed of any suitable material. For example it may be formed of Ferobestos or may be injection moulded from a plastics material.

Thus, once the turret has been assembled it is rotated step by step between successive adjustment stages in which, as each plunger 12' is brought into line with the lobe of the cam 16', the clearance between the flat bottom face of the pad 18' and the flat upper face of the closure support 17 is checked and if necessary adjusted by moving the shaft 38 upwardly or downwardly relative to the carrier 39 by virtue of the adjusting nuts 40 and 41.

Apart from the cam operated fully automatic turrets illustrated in FIGS. 2 and 4, it has also proved advantageous to construct a laboratory test rig in which a pellet of plastics material is placed manually in an upturned closure using a hand-held insertion tool operated in a similar manner to the inserter disclosed in our copending application No. 5948/73, and for this pellet of plastics material to be moved into register with a press-/heating plunger similar to the plunger 12 of FIG. 2, or the plunger 12' of FIG. 4, and then for the closure with its partially pressed plastics composition to be moved to a moulding station where a relatively cold final moulding tool is brought down manually with the assistance of lever action to compress the plastics material into its final moulded configuration. Suitable means for preheating the closure before insertion of the plastics material will, of course, be employed even if not incorporated in the actual laboratory rig.

In this way it is possible for the various parameters of the moulding process, for example the composition of the plastics material, the pre-heating temperature, the configuraton or temperature of the press/heating mould, the configuration of the moulding face of the cold mould tool and many other variables to be changed relatively easily so as to ascertain the optimum conditions for any particular type of closure. In this way the development work can be carried out on a single station machine and the lessons from this development work can subsequently be incorporated in a multistation machine similar to the turrets illustrated in FIG. 2 and FIG. 4.

The advantages of the direct conduction form of heating for the plastics composition as proposed by the present invention include the fact that the heat is now applied directly to the top face of the plastics composition by conduction, and the rate of supply of heat increases during the pressing operation because of the progressive increase in the contact area between the squashed plastics composition and the bottom pad 18, or 18' of the plunger 12 or 12'.

This improvement of deforming while heating the plastics composition assists in ensuring a more easily mouldable state for the plastics material which, on arrival at the final cold moulding station, has approximately the desired finished diameter. The cold mould now only has to carry out the final shaping operation so a much thinner centre panel can be provided in the finished gasket.

Furthermore, with the press/heating step of the present invention there is no incidence of a "shadow" of the top surface of the initial pellet in the finished gasket. This phenomenon was apparently due to the fact that the cold mould initially contacts the top face of the soft but undeformed pellet to "freeze" it so that during a subsequent moulding operation the material which was initially at the top of the pellet is never adequately deformed. With the present invention the cross-section of the pellet grows during heating and thus when the cold moulding tool impinges on the pre-pressed pellet or disc the whole of the top surface of the disc starts at a uniform temperature and finishes up at a uniform temperature immediately after moulding.

Furthermore, whereas in the past the final cold moulding tool configuration was contoured to give the finished gasket a central portion contoured in the form of a pluarlity of concentric circular ribs and grooves in order to disguise the unpleasant appearance of the "shadow, " the fact that this shadow no longer appears makes it possible for the gasket thickness to be considerably reduced in that these ribs and grooves may be eliminated if desired. This in turn provides greater economy of plastics material, an important saving having regard to the spiralling cost of plastics materials generally. However grooves or ribs may be included to give the centre panel of the gasket a more pleasing shape if desired.

The above described process is particularly suitable for use with bottle caps, such as crown caps or other caps and is especially suitable for deep drawn caps or the very deep drawn caps known by the trade name Stel Caps.

It will be appreciated that the above detailed description is intended merely to illustrate the operation of preferred forms of the invention and that several modifications can be made to the details set forth without departing from the spirit of the invention.

I claim:

1. In a method of moulding a thermoplastic material into a gasket for a container closure comprising the steps of heating a quantity of the material and deforming said material into a desired finished configuration, the improvement wherein the material in the form of a pellet is placed into the closure and is subjected to two consecutive deformation operations, the first operation being carried out with a heated pressure member which both heats the thermoplastic material and deforms it into a partially moulded configuration, and the second operation being carried out using a positively cooled moulding member, shaped to impart the desired finished configuration to the thermoplastic material, which is maintained at a temperature lower than that of the heated and partially deformed thermoplastic material.

2. The improvement of claim 1 wherein the finished article is a sealing gasket in a bottle closure and the said moulding member has a configuration which imparts to the gasket a cross-sectional form which conforms sealingly with the container to be closed.

3. The improvement of claim 2, wherein the bottle closure rests on a heated support during the first deformation operation.

* * * * *